US006182485B1

(12) United States Patent
Moore

(10) Patent No.: US 6,182,485 B1
(45) Date of Patent: Feb. 6, 2001

(54) SUPER GRIP FABRIC LOCK

(76) Inventor: Melinda A. Moore, 1162 Riverside Dr., Myrtle Creek, OR (US) 97457

( * ) Notice: Under 35 U.S.C. 154(b), the term of this patent shall be extended for 0 days.

(21) Appl. No.: 09/219,608

(22) Filed: Dec. 23, 1998

(51) Int. Cl.[7] ..... E05B 13/00

(52) U.S. Cl. ..... 70/416; 70/430; 292/258; 292/288

(58) Field of Search ..... 70/416, 429, 430, 70/202, 203, 211, 212; 292/258, 288

(56) References Cited

U.S. PATENT DOCUMENTS

| | | | |
|---|---|---|---|
| 619,035 | 2/1899 | Craddock | 70/430 |
| 1,074,359 | 9/1913 | Heimbaugh | 70/430 |
| 1,384,497 | 7/1921 | Symons | 70/430 |
| 1,700,045 | 1/1929 | Hampton | 70/430 |
| 1,955,430 | 4/1934 | Lumb et al. . | |
| 1,956,542 | 4/1934 | Wilson . | |
| 2,463,195 | 3/1949 | Mungan . | |
| 2,641,812 | 6/1953 | Boudreau | 24/182 |
| 3,585,827 | 6/1971 | Dominguez | 70/416 |
| 3,862,556 | 1/1975 | Moses | 70/416 |
| 4,279,137 | 7/1981 | Cook | 70/416 |
| 4,712,766 | 12/1987 | Ehrenhalt | 251/90 |
| 4,715,200 | 12/1987 | Katsaros | 70/211 |
| 4,827,745 | 5/1989 | Baugh | 70/416 |
| 5,008,987 | 4/1991 | Armour, II | 24/442 |
| 5,042,113 | 8/1991 | Severson et al. | 24/16 PB |
| 5,052,202 | 10/1991 | Murphy | 70/211 |
| 5,063,641 | 11/1991 | Chuan | 24/197 |
| 5,067,334 | 11/1991 | Sorkilmo | 70/416 |
| 5,136,759 | 8/1992 | Armour, II | 24/442 |
| 5,177,986 | 1/1993 | Jensen | 70/18 |
| 5,517,838 | 5/1996 | Moore | 70/416 |

FOREIGN PATENT DOCUMENTS

| | | | |
|---|---|---|---|
| 80935 | 4/1919 | (CH) | 70/430 |
| 15009 | 9/1880 | (DE) . | |
| 191952 | 5/1907 | (DE) . | |
| 454672 | 11/1936 | (GB) . | |

*Primary Examiner*—Lloyd A. Gall
(74) *Attorney, Agent, or Firm*—Richard C. Litman

(57) ABSTRACT

A deadbolt security attachment, removably installable on a deadbolt latch handle by an occupant within a room or structure, made up of a flexible strap which secures to the deadbolt handle, is wrapped about the shank of a doorknob, and is extended to secure to itself, the strap facing surfaces including hook and loop securing material. When the present device is secured between the doorknob shank and the deadbolt latch handle, the latch handle cannot be moved through its normal arc of operation to allow the door to be opened. Even if a person attempting entry to the area has a key to the deadbolt lock, the torque which may be transmitted to the lock by the key, is easily overcome by the present security strap. The present device is completely removable from the doorknob shank and deadbolt latch handle to be carried by the user when the room is not occupied.

4 Claims, 2 Drawing Sheets

SUPER GRIP FABRIC LOCK

BACKGROUND OF THE INVENTION

1. Field of the Invention

The present invention relates generally to latch and lock means, and more specifically to a portable strap for securing the deadbolt lock handle from within an occupied room. The present attachment comprises several embodiments of straps having various means of attaching around the deadbolt handle and around the shank or shaft of the adjacent doorknob.

2. Description of the Related Art

Exterior doors of homes, offices, and similar structures, as well as interior doors in hotel and apartment buildings and the like, are almost universally equipped with some form of locking means which generally immobilizes the rotating mechanism normally actuated by the doorknob to withdraw the tapered bolt from the striker plate. However, in many cases, such a lock system has been found to be insufficient, and an additional separate deadbolt lock has been added adjacent to the conventional locking doorknob latch assembly. Such deadbolts do not use tapered bolts, but rather are squared off, in order to be impossible to open by inserting a card between the edge of the door and the jamb, and working the tapered bolt back.

Such deadbolts are conventionally provided with a keyhole or the like on the exterior, so persons may access the conventional cylinder and pin type lock typically used in such deadbolt mechanisms. However, such deadbolt mechanisms are almost universally provided with a latch handle or similar means to lock and unlock the deadbolt from the interior of the structure, in order that persons within the structure can quickly evacuate the structure in an emergency, without having to locate a key for the deadbolt lock. Such deadbolts provide a significant increase in security, but nevertheless can still be opened by unauthorized persons, who may have a stolen key, or using an unauthorized master key, etc. The conventional cylinder and pin type lock mechanisms may also be vulnerable to picking without a key by skilled persons.

By definition, if the room or building is vacant of personnel, then there is no way to deter the unauthorized entrance of such a person into the area by picking or otherwise opening the deadbolt lock from the outside. However, typically such deadbolt locks are thought to add sufficient additional security, that typically no significant additional protection is provided for persons within the room or structure which has been locked from the inside by the deadbolt. Thus, a person sleeping in the room, or located in an area of the structure which is far removed from the bolted door, may not be aware of another person seeking unauthorized entry to the room or structure.

Accordingly, a need arises for an easy and economical means of securing a deadbolt handle from the interior of the door, in order to preclude unauthorized entry by other persons. The deadbolt security means must be completely portable so as to be conveniently carried by the user for use on any suitable door and lock assembly to which it is adapted. The device must provide a completely pick-proof means of assuring that the internal latch handle cannot move physically, thereby completely obviating any attempts to enter the area by picking the deadbolt lock or using a key in the lock. The present deadbolt security attachment secures between the shank or shaft of a doorknob near the deadbolt mechanism on the inside of the door, and completely prevents any movement of the deadbolt latch handle, which is positively connected to the deadbolt itself. It is significant to note that the present invention security device strap secures to the outer end of a deadbolt handle, thus changing the leverage point of the deadbolt handle from the center to an end of the handle; this provides maximum holding power with less force or pull being exerted by the user to place the security strap in the locking position. Even a key or picking instruments cannot provide sufficient torque or leverage to overcome the grip of the present security device when it is secured to the deadbolt latch handle.

A discussion of the related art known to the present inventor, and its differences and distinctions from the present invention, is provided below.

U.S. Pat. No. 619,035 issued on Feb. 7, 1899 to Thomas Craddock describes a Key Fastener for holding a key for a tumbler type lock in a generally horizontal position within the lock, to preclude turning the key and thus withdrawing the latch bolt. The device must secure through the open handle end of the key, rather than around a deadbolt latch handle, as with the present invention. The present security device is formed of a flexible strap devoid of rigid components, unlike the Craddock fastener.

U.S. Pat. No. 1,074,359 issued on Sep. 30, 1913 to Arthur M. Heimbaugh describes an Attachment For Keys, comprising a spring or band which is removably securable about the shank of a doorknob and a chain which is attachable to the cylindrical shaft of a key. The device does nothing to prevent the key from being turned within the lock or from being pushed from the lock. The sole function of the device is to secure the key adjacent to the lock, to prevent loss of the key.

U.S. Pat. No. 1,384,497 issued on Jul. 12, 1921 to Edwin F. Symons describes a Key Holder which is structurally and functionally similar to the device of the Heimbaugh patent discussed immediately above. As in the case of the Heimbaugh device, the Symons device does nothing to prevent the key from being turned in the lock or from being pushed from the lock.

U.S. Pat. No. 1,700,045 issued on Jan. 22, 1929 to Charles W. Hampton describes a Key Protector, comprising a thin metal strap which functions similarly to the Heimbaugh and Symons devices discussed above. Again, no means of preventing the key from being turned in the lock, or from being pushed from the lock from the opposite side, is provided by the Hampton device.

U.S. Pat. No. 1,955,430 issued on Apr. 17, 1934 to Isaac F. Lumb et al. describes a Key Fastener which connects between a key inserted in a tumbler lock and the shank of an adjacent doorknob. The device applies tensile force to the eye of the key handle. However, it appears that the device would rotate the key to a vertical, removable position, rather than precluding its turning.

U.S. Pat. No. 1,956,542 issued on Apr. 24, 1934 to Louis P. Wilson describes a Key Fastener comprising a hook formed of sheet metal, which hooks around the shank of a doorknob. The end of the hook is extended to fit through the eye of the handle end of a key, in the manner of the Craddock and Lumb et al. devices discussed above. The relatively rigid extension precludes the turning of the key relative to the doorknob shank above, to which the hook is secured to preclude turning the device itself. As in the case of the Craddock and Lumb et al. devices discussed above, the Wilson device is also inoperable in securing a deadbolt latch handle, as no means is provided for securing the device to the solid deadbolt handle to prevent its rotation.

U.S. Pat. No. 2,463,195 issued on Mar. 1, 1949 to Paul F. Mungan describes a Locking Device comprising a hasp type lock, similar to a bicycle lock, with a lockable but removable key operated locking mechanism which adjustably locks to the hasps. The opposite end is adapted to fit over a specifically sized and shaped deadbolt latch handle, to cover it completely. When the hasp and lock portion are secured over the shank of a doorknob, the deadbolt latch handle is completely protected and cannot be turned. The Mungan device is well adapted to preclude a person with access to the deadbolt latch handle from operating the handle and opening the door, e. g., by breaking a panel of the door and reaching through to operate the deadbolt latch. However, the Mungan device would preclude rapid exit from the room or structure in an emergency, whereas the present invention may be removed rapidly.

U.S. Pat. No. 2,641,812 issued on Jun. 16, 1953 to Charles Boudreau describes a Belt Fastener comprising a plate with one or more pins projecting therefrom, which plate is secured to one end of the belt. The pins engage one or more holes in the opposite end of the belt to secure the two ends of the belt together. Such an attachment might be used to secure portions of the present strap invention together, but Boudreau fails to disclose any means of attaching a belt or strap using his invention, to a doorknob shank and deadbolt latch handle.

U.S. Pat. No. 3,585,827 issued on Jun. 22, 1971 to Domingo Dominguez describes a Security Lock similar in configuration to the device of the Mungan patent discussed above. The Dominguez device comprises a semi-rigid forked portion which straddles the doorknob shank, with an adjustable closure which fits about the deadlock latch handle. No locking means is disclosed; the latch handle closure is secured in place by a threaded fastener. Thus, the Dominguez device has all of the disadvantages of the Mungan device discussed above, e. g., it is bulky, relatively heavy, and cumbersome and time consuming to remove in the event one needs to leave the room quickly.

U.S. Pat. No. 3,862,556 issued on Jan. 28, 1975 to Adolph Moses describes a Door Lock Attachment comprising a wire fork which fits around the doorknob shank, with an end shaped to fit around a deadbolt latch handle. The device is specifically formed to fit only a specific configuration of doorknob and deadbolt latch handle configurations, unlike the present strap.

U.S. Pat. No. 4,279,137 issued on Jul. 21, 1981 to Roy O. Cook describes a Security Device comprising a plate having a forked end which fits over a doorknob shank and an opposite end having a housing which captures the deadbolt latch handle therein. The same limitations apply here as to the Moses device described above, with the device also being relatively large and bulky to preclude convenient packing for travel.

U.S. Pat. No. 4,712,766 issued on Dec. 15, 1987 to Caradoc Ehrenhalt describes an Easy Squeeze Nozzle Holder adapted to hold the handle of a gasoline nozzle to relieve a person from the need to hold the handle while dispensing gasoline. The device comprises a strap with mating hook and loop fastening material on opposite sides of opposite ends thereof. The present strap may utilize similar mutual attachment means, but the Ehrenhalt strap is not sufficiently long to secure around a doorknob shank and an adjacent deadbolt latch handle, nor does Ehrenhalt provide any means of attaching his strap to a deadbolt latch handle.

U.S. Pat. No. 4,715,200 issued on Dec. 29, 1987 to James Katsaros describes a Locking Device For A Door Lock, comprising a single elongated bar which rests against one side of the doorknob shank with a box-like structure at the upper end thereof for clamping to a deadbolt latch handle. The device secures to the handle using several thumbscrews to clamp the handle immovably relative to the device. The relatively bulky, rigid nature of the Katsaros device, and its relative difficulty in removing from the latch handle, are unlike the present invention.

U.S. Pat. No. 4,827,745 issued on May 9, 1989 to Benton F. Baugh describes a Lockset Security Device comprising a device adapted to fit over a deadbolt latch handle and also over the protruding rotatable lock button of a lock integrated with a doorknob. A chain connects the two components together, to prevent rotation of the assembly. The rigid enclosure about the deadbolt latch handle is more closely related to the devices of the patents to Dominguez and Cook, discussed further above, than to the present invention.

U.S. Pat. No. 5,008,987 issued on Apr. 23, 1991 to Thomas W. Armour, II describes a Multi-Purpose Fastening Device comprising various embodiments of a strap having different hook and loop end configurations, buckles, etc. While Armour, II discloses the use of different types of mating hook and loop fastening material disposed on opposite sides of a strap end, no disclosure is made of using different types of hook and loop material on different areas of the same side of a strap, nor of mixing different types of hook and loop material on the same surface so the surface may be doubled back upon itself to secure to itself at any point thereover, as provided by the present invention.

U.S. Pat. No. 5,042,113 issued on Aug. 27, 1991 to Sandra S. Severson et al. describes an Elastic Connector comprising an elongated strap with bifurcated opposite ends. The snap fastener attachment means is incapable of providing sufficient adjustment for use in securing a deadbolt latch handle, and the elastic material is unsuitable for such use in any event.

U.S. Pat. No. 5,052,202 issued on Oct. 1, 1991 to Jerry A. Murphy describes a Dead Bolt Locking Device related to the devices of the Dominguez and Cook patents discussed further above. The Murphy device comprises a relatively heavy, rigid unit having a forked lower portion which fits about the shank of a doorknob, with an upper portion having a cruciform opening therethrough. The opening is shaped to accept a specific shape of deadbolt latch handle therein, in either of the two orientations defined by the cruciform opening. A thumbscrew secures the device to the latch handle. Other embodiments are also disclosed. The present flexible strap configuration, and its lack of screw attachments and the like which require excessive time to loosen in an emergency, serve to differentiate the present invention from the Murphy device.

U.S. Pat. No. 5,063,641 issued on Nov. 12, 1991 to Chiang C. Chuan describes a Buckle For Locking Straps, comprising a strap with a pair of infinitely adjustable buckles. While the buckle adjustment means might be used with the present invention, the hooks extending from each end of the strap are unsuitable for securing between a doorknob shank and deadbolt latch handle.

U.S. Pat. No. 5,067,334 issued on Nov. 26, 1991 to Clayton O. Sorkilmo describes a Door Lock Security Device comprising a bifurcated unit with legs of tapered thickness. The device is wedged between a deadbolt latch handle having a T configuration, and the adjacent door or lock plate surface. The device is not operable on latch handles having other configurations, nor does it secure to the doorknob assembly.

U.S. Pat. No. 5,136,759 issued on Aug. 11, 1992 to Thomas W. Armour, II describes a Multi-Purpose Fastening Device similar to that described in his earlier '987 patent discussed further above. The same distinctions and limitations of his device, in comparison to the present invention, are seen.

U.S. Pat. No. 5,177,986 issued on Jan. 12, 1993 to Wayne P. Jensen describes a Lockable Tie Strap configured to form two connected loops. One end of the strap is locked to form the loops, by passing a lock hasp through one of several grommets in the strap. The device cannot be used to secure a deadbolt latch handle, as insufficient adjustment is provided by the limited number of grommets along the strap.

U.S. Pat. No. 5,517,838 issued on May 21, 1996 to Melinda A. Moore describes a Portable Pick-Proof Deadbolt Attachment. The present invention, by the same inventor, includes numerous novel variations over the earlier device. The present invention includes different means of securing the strap to the deadbolt latch handle or lever, as well as different hook and loop material arrangements along the strap to provide further versatility.

German Patent Publication No. 15,009 published on Sep. 22, 1880 illustrates a generally L-shaped device which clamps to a rotary latch lever or handle. The distal handle end provides no means of securing the device to a doorknob shank or the like, to preclude rotation of the device in the event the latch handle is rotated to unlock the door. The present invention connects the latch handle to the doorknob shank, to prevent latch rotation.

German Patent Publication No. 191,952 published on May 7, 1907 illustrates a device having a function similar to that of the devices of the U.S. Patents to Craddock, Lumb et al., and Wilson discussed further above. A bifurcated, elongate spring portion is passed through the eye of a key handle, with the two elongated portions then being passed to either side of the shank of the door latch handle. The key cannot rotate due to its capture on the device, which in turn cannot rotate as it is secured around the latch shank. However, no means is provided to secure a deadbolt latch handle against rotation, as in the present invention.

Swiss Patent Publication No. 80,935 published on Apr. 16, 1919 illustrates various embodiments of a spring hook. Some of the embodiments include hooks on both ends of the device, but none of the embodiments are suitable for use in securing a deadbolt latch handle to prevent rotation thereof, as provided by the present strap invention.

Finally, British Patent Publication No. 454,672 published on Nov. 5, 1936 describes Improvements In Or Relating To Security Attachments For Door And Like Fastening Means. The device is a hollow case, split diametrically to secure about the latch knob. The halves are secured together by a concentric screw arrangement, or alternatively a combination lock. The device is cumbersome and time consuming to install and remove, and cannot secure to the doorknob shank to tie the shank and latch handle together.

None of the above inventions and patents, either singly or in combination, is seen to describe the instant invention as claimed.

SUMMARY OF THE INVENTION

The present invention comprises a deadbolt security attachment, allowing persons within a room or structure to secure the deadbolt handle of a door so equipped, to absolutely prevent unauthorized entry from outside by persons operating the deadbolt. The device has a pocketed or looped end placed over the one end of the deadbolt handle, and a slit adjacent this end through which the other end of the deadbolt handle is inserted. This action is undertaken in clockwise fashion, or deadbolt-locking direction, so as to assure that the strap is forcing the deadbolt handle into the locked position. The strap then is wrapped about the shank or shaft of a doorknob handle, and then back upon itself between the doorknob shaft and the deadbolt, using hook and loop material to secure the strap solidly to itself. Various means may be used to secure the present strap to the deadbolt latch handle, including using multiple wraps about the handle, securing the strap about the handle using hook and loop fastener material, forming a latch handle receiving pocket or loop in the latch handle attachment end of the strap, and/or providing a hook or ring at the latch handle attachment end of the strap, but a pocket or perhaps a loop are the preferred structures for accomplishing the desired result.

It will be appreciated that the strap may be wound and used in a counterclockwise fashion, for deadbolt handles which turn counterclockwise to project the lock bolt into a locking position. In this case, the invention is not altered or changed one wit; it is simply deployed in mirror fashion with respect to a clockwise-turning deadbolt handle to a locked position. Thus, the invention is completely interchangeable with deadbolt locks of any configuration, and usable, of course, with either right-hand or left-hand hung doors.

Accordingly, it is a principal object of the invention to provide an improved deadbolt security attachment for positively securing an interior deadbolt latch handle against movement, to preclude unauthorized entry into the room from the outside, while the room is occupied.

It is another object of the invention to provide an improved deadbolt security attachment comprising a flexible fabric strap which is completely removable from the knob and latch components, having temporary attachment means to itself along its major portion, and temporary deadbolt handle immobilizing means at the opposite end.

It is a further object of the invention to provide an improved deadbolt security attachment strap which may include mating hook and loop attachment means disposed upon its interior surface, for securing the strap to itself, about a doorknob handle shank, and which may include further cooperating pocket or loop with slit means at one end, for immobilizing the deadbolt handle.

An additional object of the invention is to provide an improved deadbolt security attachment which deadbolt handle attachment means may comprise a loop or pocket formed in the deadbolt handle attachment end of the strap, or which could comprise a metal loop, ring, or the like secured to the deadbolt handle attachment end.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
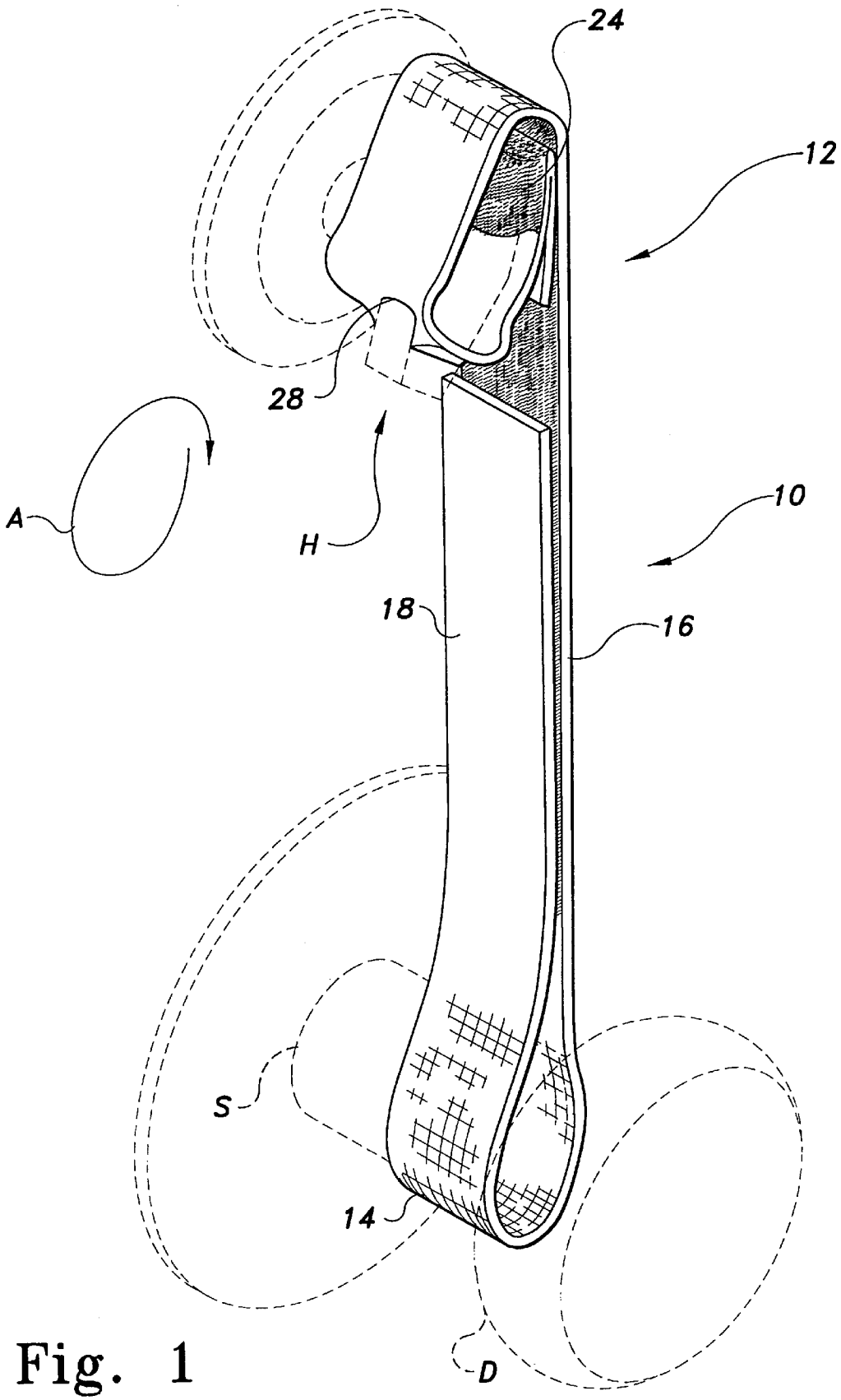
FIG. 1 is an environmental perspective view of a first embodiment of the present deadbolt security attachment, showing its temporary and removable installation about a doorknob shank and a deadbolt handle, the strap being placed and wound about a deadbolt handle in a clockwise fashion.

The present invention comprises a deadbolt security attachment strap, one embodiment of which is shown in FIG. 1 and designated by the reference numeral 10. The strap 10 is preferably formed of a solid, unbroken, flexible length of fabric material, such as nylon webbing or other durable, strong synthetic fabric material. Other materials may be used, of course.

The strap 10 includes a deadbolt handle attachment end 12 for securing about a deadbolt latch handle H, a doorknob shank intermediate end 14 for wrapping about the shank S of a doorknob D, a medial portion 16 between the two end portions 12 and 14, and a securement end 18, to secure the strap back upon itself to latch the invention in place and immobilize the deadbolt handle.

Figure 2:
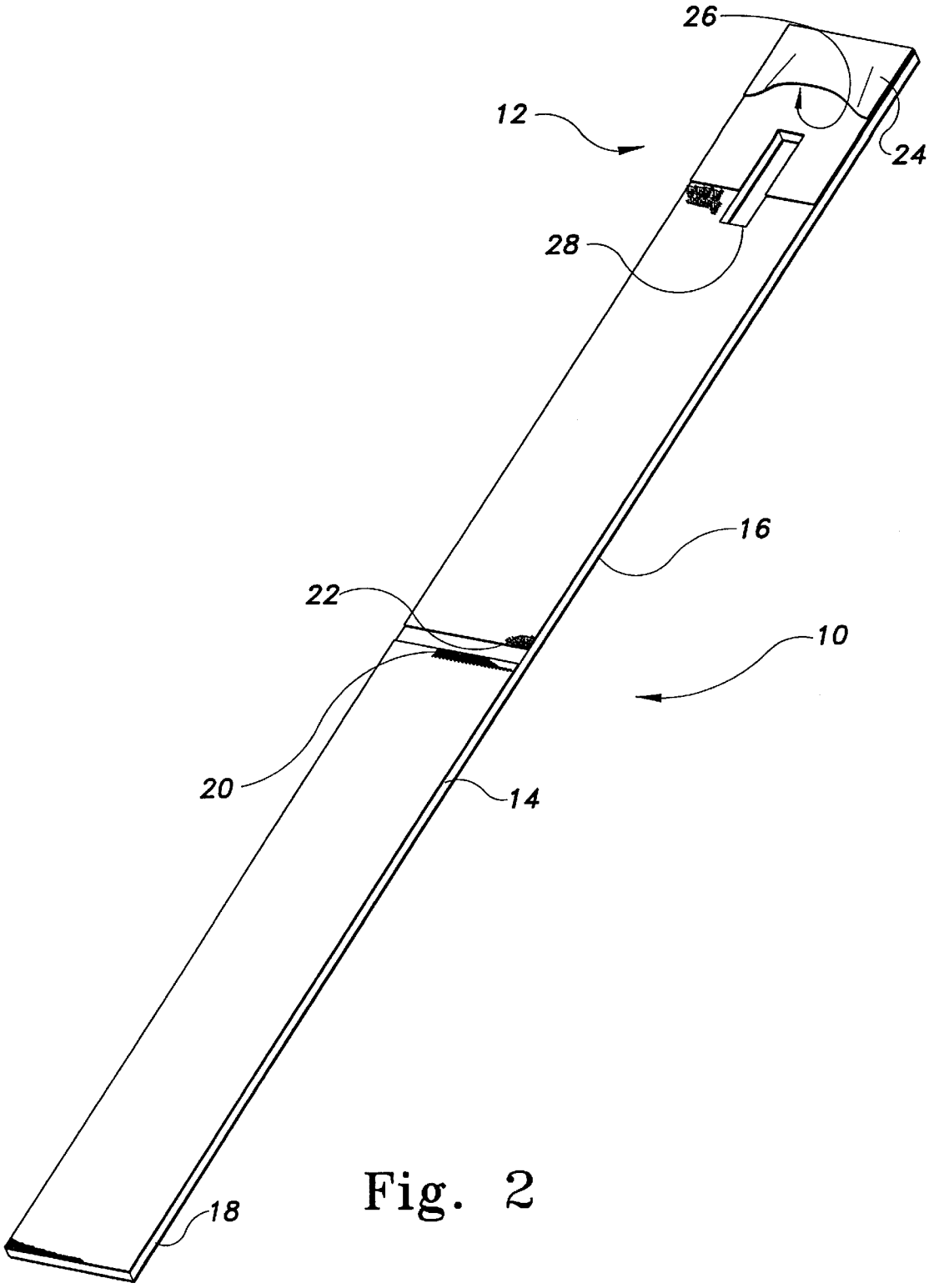
FIG. 2 is a perspective view of the invention, clearly showing the hook and loop interior and the securing pocket construction.

With reference to FIG. 2, it is seen that the strap 10 of FIG. 1 further includes a first, loop material surface 20 and an second, cooperating hook material surface 22, which surfaces 20 and 22 may include various means of securing to one another to provide for wrapping around or otherwise securing to a doorknob shank S and a deadbolt latch handle H. The surfaces could be reversed, but for the comfort of the user, the arrangement shown is better.

The opposite deadbolt handle attachment end 12 of the strap 10 includes a pocket or loop 24, open at 26 to receive one handle end of the deadbolt handle H. Further down this end is an optional slit 28 formed completely through the end 12, to accommodate the other end of the deadbolt handle H, as can be appreciated from FIG. 1. Thus, assuming the deadbolt configuration is such that a clockwise turn locks the deadbolt, as indicated by the arrow A in FIG. 1, then the pocket 24 is placed over a deadbolt handle end as shown, the strap is brought clockwise beneath the second handle end so that the strap slit 28 engages that handle end, the strap is brought over the top of the deadbolt handle and down and under the doorknob shank S, with portion 14 therebeneath, and drawn up again and placed against the portion 16 of the strap so that hook and loop portions engage, thus to have the invention in place, immobilizing the deadbolt handle H, and thus the deadbolt itself.

It is to be noted here that the locking and holding power of the invention is obtained by changing the leverage point of the deadbolt handle from its center to its end, so that even an excessive amount of force cannot dislodge the invention from place. To employ an anology, more leverage is provided when using a crowbar when force is applied to its end, far from the fulcrum. Similarly here, the pocket placed over a deadbolt handle end followed by wrapping the strap in the direction of deadbolt lock extension, and then pulling down on the strap, wrapping it about the doorknob shank, and then locking the strap to itself by a hook and loop fastener, assures that the deadbolt handle is not going to be turned in the reverse direction by an intruder. As for the slit adjacent the pocket, this feature facilitates the interengagement of strap with deadbolt handle, but is not absolutely essential to the proper functioning of the invention.

It will also be fully appreciated here that the shear strength of the mating hook and loop fastener material 20 and 22 at the strap end 18 and medial portion 16 of the strap 10, is more than sufficient to prevent the strap from being pulled from the doorknob shank by the twisting or turning of a key within the outer lock of the deadbolt, thus securing the room or structure by an occupant from within.

It will also be fully appreciated that the invention works on oppositely hung doors from that shown, and/or on deadbolts that rotate in a counterclockwise position to a locked disposition, without need of altering or changing the invention at all. Pocket and slit of the strap end 12 are simply placed and wound counterclockwise to immobilize the deadbolt handle, and then the strap is simply brought under the doorknob shank and back upon itself to secure the invention in place. Accordingly, it is seen that the invention is fully interchangeable with deadbolt configurations of any sort at all.

Returning to the pocket 24 as shown in the drawings, it is to be understood that the term "pocket" is to include any conceivable structure for assuring positioning of this end 12 of the strap over an end of the deadbolt handle H. Thus, a loop could be employed, or a metal ring, or an encircling band, a metal or other material cap, an elastic band, a hook, or virtually any other means for the purpose stated that would suggest itself to a routineer in the art.

In summary, the present deadbolt security attachment strap in its various embodiments will be seen to provide an improvement in the art, due to its versatility and increased number of variations of attachment to a deadbolt latch handle. While the present invention is intended to be completely portable and to serve as a temporary means of securing a deadbolt from within a room or structure by an occupant of the room or structure, it will be further seen that the doorknob shank attachment end may be permanently affixed to the doorknob shank, if desired, so the device will always be ready for use.

The present security attachment in its various embodiments is quite effective, serving to restrain or prevent movement of the deadbolt latch handle relative to the doorknob of a door. Since the deadbolt latch handle cannot be moved to any significant degree, the lock cylinder attached directly to the deadbolt latch handle also cannot be turned sufficiently to withdraw the deadbolt from its corresponding latch plate within the door frame, thus preventing entry into the room by unlocking or otherwise operating the deadbolt. Yet, the present device is inexpensive to produce, and serves well as a complementary handout or souvenir for hotels, motels, and other business concerns.

The strap may include advertising, instructions, and/or other indicia thereon, as desired. Such advertising would serve well to remind a user of the present device, of the hotel or other facility at which he or she obtained the security attachment, to attract further stays or use of an associated product.

It is to be understood that the present invention is not limited to the embodiments described above, but encompasses any and all embodiments within the scope of the following claims.

I claim:

1. A deadbolt security attachment, comprising:

a solid, unbroken, flexible strap;

said strap having a deadbolt handle attachment end, an opposite doorknob shank wrapping end, and a medial portion extending therebetween;

said strap further having a first surface and an opposite second surface;

said first surface of said doorknob shank wrapping end including a first hook and loop fastening material disposed thereon, and said first surface of said medial portion including a mating second hook and loop fastening material disposed thereon, for wrapping said doorknob shank wrapping end of said strap about a doorknob shank and for temporarily and removably securing said first surface of said doorknob shank wrapping end to said first surface of said medial portion of said strap about the doorknob shank; and said door handle attachment end including a pocket for receiving and substantially enclosing an end of a deadbolt handle.

2. The deadbolt security attachment according to claim 1, wherein said pocket is formed by a piece of material attached to said deadbolt handle attachment end, for capturing an end of the deadbolt handle therein.

3. The deadbolt security attachment according to claim 1, wherein said pocket is formed by folding over said deadbolt handle attachment end of said strap onto itself, for capturing an end of the deadbolt handle therein.

4. The deadbolt security attachment according to claim 1, there further being a slit formed through said strap adjacent said pocket, said pocket and said slit being dimensioned, configured and arranged such that both ends of a deadbolt handle are engaged by said pocket and slit respectively, by a simple placement of the pocket over one end of the deadbolt handle, followed by insertion of the slit onto the other end of the deadbolt handle.

* * * * *